US005811713A

United States Patent [19]

Gudgel

[11] Patent Number: 5,811,713

[45] Date of Patent: Sep. 22, 1998

[54] APPARATUS FOR LAUNCHING PROJECTILES

[76] Inventor: John Gudgel, 8312 E. 112th St. South, Bixby, Okla. 74008

[21] Appl. No.: 745,283

[22] Filed: Nov. 8, 1996

Related U.S. Application Data

[63] Continuation-in-part of Ser. No. 666,756, Jun. 19, 1996, Pat. No. 5,592,770.

[51] Int. Cl.[6] ..... F41C 27/06

[52] U.S. Cl. ..... 89/1.34; 42/105; 102/504; 441/85

[58] Field of Search ..... 89/1.34, 30, 31; 42/105, 1.15; 102/504; 441/85

[56] References Cited

U.S. PATENT DOCUMENTS

| | | | |
|---|---|---|---|
| 2,335,299 | 11/1943 | Moore . | |
| 2,770,904 | 11/1956 | Weiss | 42/105 |
| 2,883,781 | 4/1959 | Harvey . | |
| 3,007,271 | 11/1961 | Brandt . | |
| 3,243,909 | 4/1966 | Kotikov . | |
| 3,392,469 | 7/1968 | Dubini . | |
| 3,409,232 | 11/1968 | Cholin | 89/14.3 |
| 3,505,926 | 4/1970 | Johnson . | |
| 3,534,492 | 10/1970 | Amster . | |
| 3,583,087 | 6/1971 | Huebner | 42/105 |
| 3,618,244 | 11/1971 | Johnson . | |
| 3,717,946 | 2/1973 | Chavee . | |
| 4,098,015 | 7/1978 | Walbe . | |
| 4,154,013 | 5/1979 | Stilwell . | |
| 4,341,030 | 7/1982 | Little . | |
| 4,799,906 | 1/1989 | Perkins, Jr. | 89/1.34 |
| 5,448,937 | 9/1995 | Buc et al. | 89/1.34 |

FOREIGN PATENT DOCUMENTS

| | | | |
|---|---|---|---|
| 20960 | 2/1920 | France | 42/105 |
| 846100 | 9/1939 | France | 42/105 |
| 109509 | 9/1917 | United Kingdom | 42/105 |
| 124799 | 4/1919 | United Kingdom | 102/504 |
| 129740 | 7/1919 | United Kingdom | 42/105 |
| 189346 | 11/1922 | United Kingdom | 102/504 |
| 614380 | 12/1948 | United Kingdom | 42/105 |

*Primary Examiner*—Stephen M. Johnson
*Attorney, Agent, or Firm*—William S. Dorman

[57] ABSTRACT

Apparatus for launching a projectile comprising a male launching tube having an attachment end and a discharge end opposite from the attachment end, an energy device having a discharge end and having the capability of producing an instantaneous discharge of gas under high pressure from its discharge end, the attachment end of the male launching tube being connected to the discharge end of the energy device whereby the high pressure gases discharging from the discharge end of the energy device are passed through the male launching tube and out the discharge end thereof, a collar mounted on the male launching tube between the discharge end and the attachment end, and a projectile adapted to be mounted on the male launching tube between the discharge end thereof and the collar whereby, when the energy device discharges gas therefrom under high pressure, the projectile will be launched into ballistic flight, the collar having a port extending radially therethrough to the male launching tube, wherein the male launching tube is provided with a first radial hole extending through the male launching tube communicating with the radial port in the collar and with the interior of the male launching tube.

13 Claims, 7 Drawing Sheets

APPARATUS FOR LAUNCHING PROJECTILES

CROSS-REFERENCE TO RELATED APPLICATIONS

This application is a continuation-in-part of my prior application Ser. No. 08/666,756, filed Jun. 19, 1996, and entitled "Shotgun Mounted Launching Device and Launching Projectile" now issued as U.S. Pat. No. 5,592,770.

BACKGROUND OF THE INVENTION

1. Field of the Invention

A launching device made to mate within the discharge end of a standard readily available shotgun equipped with a factory or private installed interchangeable choke system, or to mate within or upon or outside the discharge end of any other type firearm, energy device, or pressure powered device, when used with the appropriate adapter or conversion modification(s) to receive the launcher for many functions of which examples of a few uses include but are not limited to the following; throwing a line or cable and buoyant projectile on land use, in/on water use, in air use, in space use, and for throwing a line or cable using a launchable grappling hook type projectile for uses in mountain and forest activities, multiple-story building fire and like rescue situations, as well as non-rescue situations such as throwing lines over streams, trees, gorges, rivers, roofs, from ship-to-ship, and other type projectiles for casting fishing nets, fishing lines, fishing lures, commercial and industrial uses, and a dead duck projectile that can be used in the training and exercising of retrieving dogs.

2. Description of the Prior Art

Numerous projectile gun devices have been proposed or utilized to launch a projectile and simultaneously produce an explosive report to simulate a shotgun report in training retrieving dogs in order to build the animal's experience and confidence in a hunting type situation. Exemplary devices of this general type are illustrated in U.S. Pat. Nos. 3,505,926; 4,154,013; and 4,341,030.

The previous art devices have tried the employment of "O-rings" to adjust the distance while using a specific amount of propellant energy charge, but the variable in distance is minimal and inadequate. When using the devices of this general type, better variables in distance can be achieved by employment of different amounts of propellant energy charges (low propellant energy charge=short range, medium propellant energy charge=medium range, and high propellant energy charge=long range). The requirement for low, medium, and high propellant energy charges rather than a single propellant energy charge is a major disadvantage of all the previous devices of this general type.

Another major and dangerous disadvantage of all the prior art devices is their inability to allow the extreme pressure of the propellant energy charge to escape from the launching device should some female launching tube of the projectile become bound to the male launching tube, or too heavy a projectile on the male launching tube, or should some other type of bore obstruction occur which could result in a burst barrel or burst discharge end of any type firearm, energy device, or pressure powered device, and/or cause extreme bodily injury to the operator.

3. Objects and Advantages

It is therefore an object of these improvements to the inventor's original design to provide a Safety Pressure Valve to allow the extreme pressures of the propellant charge or other energy pressure source, to safely escape from the launching device in the presence of a bore obstruction or excessive pressure, without injury to the operator, or damage to the shotgun, other type firearm, energy device, or pressure powered device, or the launching device.

Another object of this invention is to allow the operator to widely adjust the desired distance of the projectile while using a specific amount of propellant energy charge or energy pressure charge, by incorporating the use of pressure exhaust ports. By allowing controlled amounts of the propellant energy charge to escape from the launcher device through the pressure exhaust ports, various amounts of propellant energy charge can be delivered more effectively to the internal surface of the female launching tube to achieve the desired distance of launch or throw of a projectile.

Another object of this invention is to allow the operator to easily adjust the launcher for the desired distance without having to use or maintain a multitude of different specific amounts of propellant energy charges.

Another object of this invention is to provide a buoyant projectile capable of carrying a rope, line, or cable, to aid in rescue and non rescue type situations.

Another object of this invention is to provide a projectile capable of immobilizing targeted objects, wherein the projectile and launching device serve as a real STUN-GUN device.

Another object of this invention is to provide adapter devices which will allow the launcher device to be used with any type of firearm, energy device, or pressure powered device having a discharge end for receiving the appropriate adapter and launching device, or capable of being modified to receive the launching device or any parts of the launching device to convert the firearm, energy device, or pressure powered device, having a discharge end to receive and use the launching device.

Another object of this invention is to provide pressure exhaust ports to reduce the amount of strain and pressure, recoil, and muzzle rise, on the firearm, energy device or pressure powered device.

SUMMARY OF THE INVENTION

A launching device is designed to mate with the discharge end of any type of firearm, energy device, or pressure powered device. The launching device includes a male launching tube which has an attachment end and a discharge end. The attachment end of the male launching tube can be connected to the barrel of a shotgun or other firearm, or directly to the discharge end of an energy device such that the male launching tube would then be the barrel of the gun. A collar, preferably but not necessarily round, is mounted on the male launching tube between the discharge end and the attachment end. A projectile is adapted to be mounted on the male launching tube; for this purpose, the projectile is provided with a female launching tube in which the male launching tube is received.

The collar is provided with a plurality of radial ports extending from the periphery of the collar to the exterior surface of the male launching tube. In turn, the male launching tube is provided with a plurality of radial holes which mate with the radial ports in the collar.

One of the radial ports is preferably a pressure port which can be provided with a removable plug. When the removable plug is out of the pressure port, the pressure port modifies the gas pressure coming out of the discharge end of the male launching tube so as to provide a means for varying the length of the flight path of the projectile.

Another port in the collar is preferably a safety port in which a pressure safety device can be mounted to prevent the pressure within the male launching tube from exceeding a predetermined value in the event a projectile becomes stuck on the launching tube or some other problem occurs in the system which results in an unusually high pressure in the system.

Another port in the collar is preferably a locking port wherein a pin is received which extends all the way into the radial opening in the male launching tube to secure the collar on the launching tube, thereby preventing rotation of the collar relative to the launching tube.

A variety of different types of projectiles are provided, including a harpoon projectile, a "payload" projectile for delivering lines or cables to a remote location, a buoyant projectile, a grappling hook projectile, and a projectile which has a covering simulating the form of a dead bird or other animal.

Figure 17:
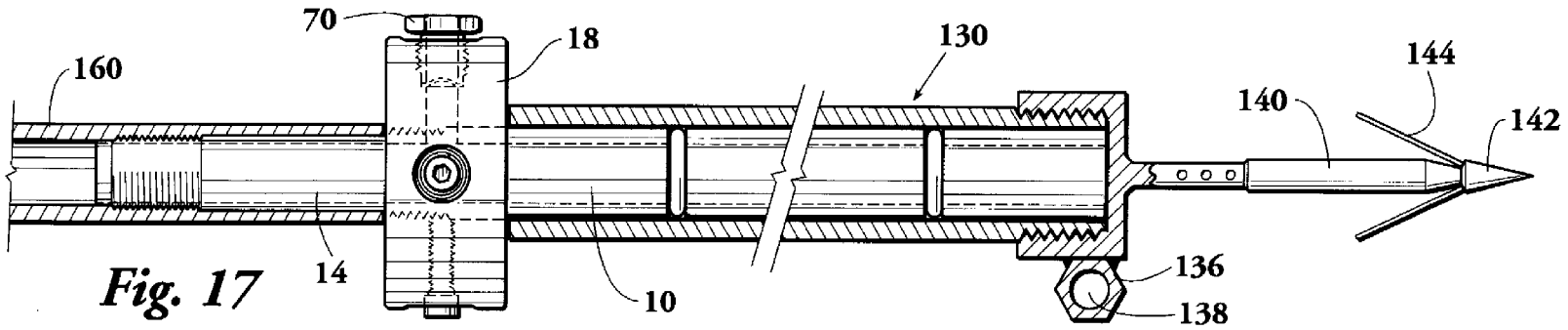
FIG. 17 is a longitudinal sectional view showing the projectile of FIG. 10 mounted on the launching tube of FIG. 1, the latter being associated with the discharge end of a shotgun or other energy device.

FIG, 18 is an exploded view of the elements shown in FIG. 17.

DETAILED DESCRIPTION OF THE PREFERRED EMBODIMENTS

Figure 1:
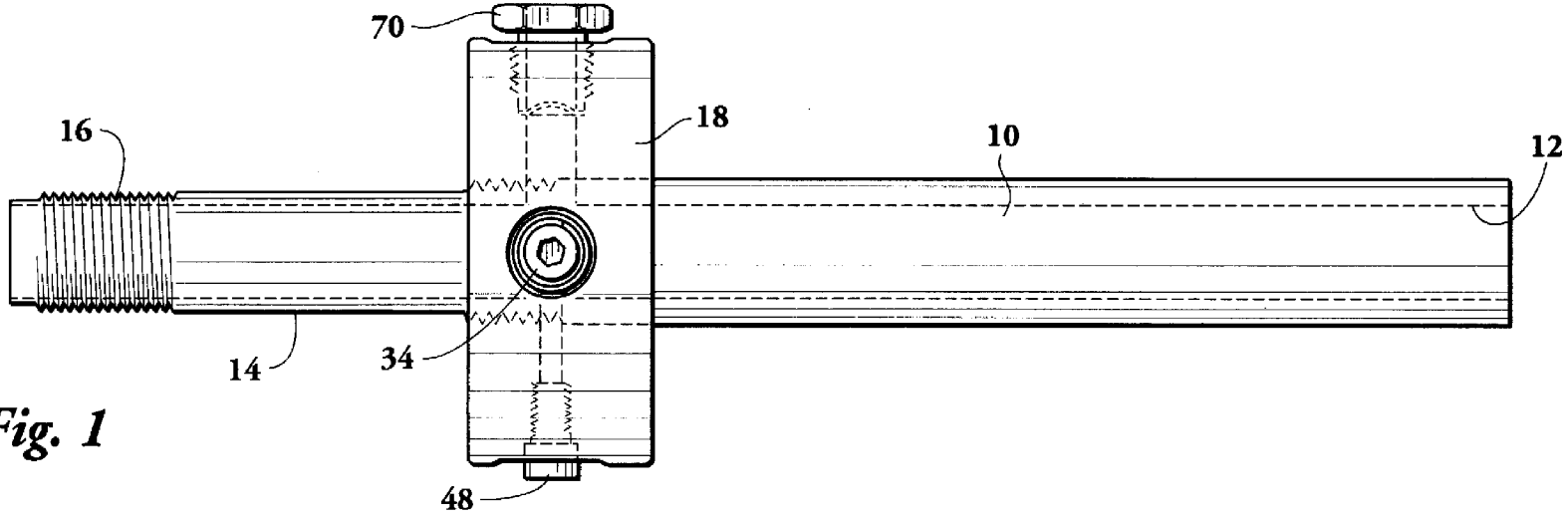
FIG. 1 is an elevational view of one embodiment of the invention showing a launching tube with a circumferential collar mounted thereon.
Figure 3:
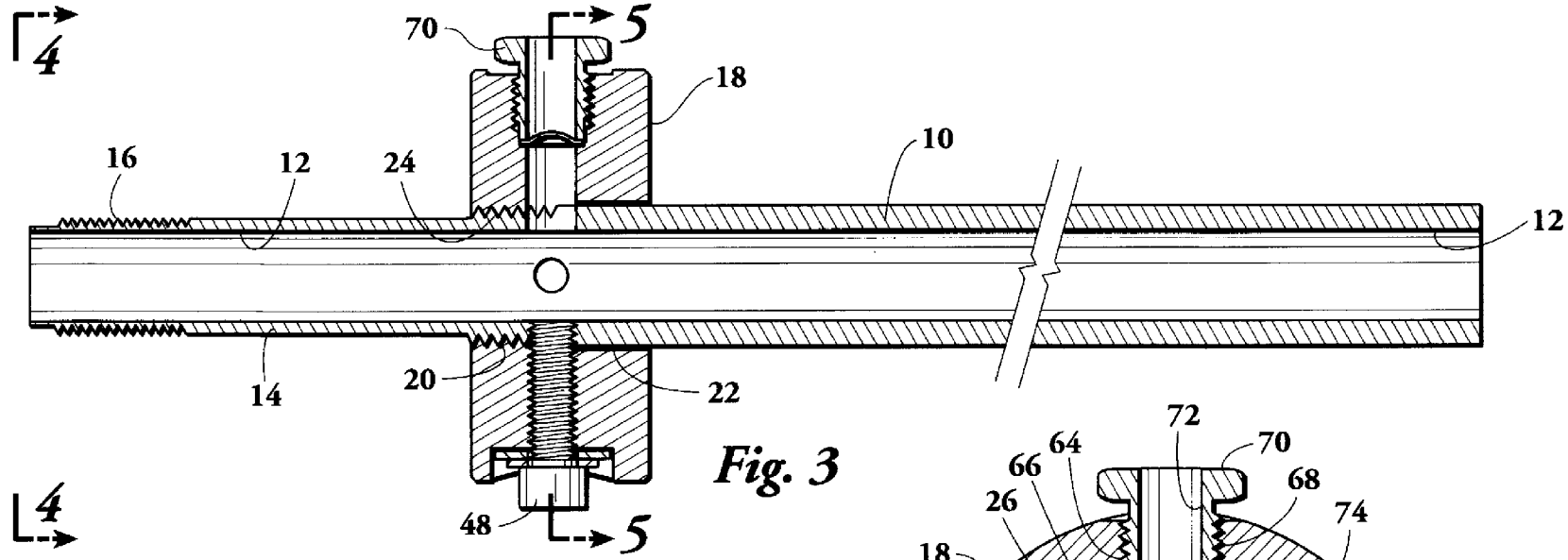
FIG. 3 is a longitudinal sectional view of the elements shown in FIG. 1.

Referring to the drawings in detail, FIGS. 1 and 3 show a male launching tube or shaft 10 which is adapted to cooperate with a projectile in a manner later to be described. The male launching tube 10 has a longitudinal bore 12 therethrough. The left-hand end 14 of the launching tube 10 is of slightly reduced external diameter, and this portion can be referred to as the adapter end 14 of the tube 10. At the extreme left-hand end of the adapter portion 14 are threads 16 which are designed to mate with the internal threads on the choke receiving portion (not shown) of a shotgun (not shown) or other type firearm or energy device for a purpose which will hereinafter appear.

A circumferential collar 18 (the details of which will be hereinafter disclosed in detail) is received on the male launching tube 10 generally in the location where the right-hand portion of the tube 10 merges with the adaptor portion 14. At this merging location, the external surface of the tube 10 is provided with a threaded portion 20. A right-hand central portion of the collar 18 is provided with a bore 22 which is slightly larger than the external diameter of the launching tube 10, whereas the left-hand central portion of the collar 18 is provided with a threaded portion 24 which is adapted to mate with the threads 20 on the launching tube 10. Thus, if the collar 18 is inserted over the left-hand end of the adaptor portion 14, the collar can then be screwed on with the threads 24 of the collar mating with the threads 20 on the male launching tube 10; at the same time, the bore 22 will be received over the left-hand unthreaded portion of the larger diameter of the launching tube 10.

Whereas the collar 18 has been described as "circumferential", it should be obvious that its external shape is not critical; for example, the collar could be shaped in the form of a square, a hexagon or even triangular (or some other regular or irregular shape). The same considerations hold true for the shapes of other elements disclosed herein, such as the male launching tube and the female launching tube. Both are shown in the drawings as being cylindrical; however, these tubes could be square, triangular, hexagonal, etc. just so long as the tubes were shaped so as to be compatible with each other.

The collar 18 is provided with an upper vertical port or hole 26 that extends radially from the top of the collar 18 through to the center of the collar; two side ports 28 and 30 which extend laterally (and radially) from the outside of the collar to the interior thereof; and a vertical bottom port 32 which extends radially from the lowermost outer surface of the collar 18 to the center thereof. Identical cap screws 34 and 36 are received in threaded portions 38 and 40, respectively, of the ports 28 and 30. The outer ends of the ports 28, 30 and 32, are countersunk as at 42, 44 and 46. A third cap screw 48 is received in a threaded portion 50 of the lower vertical port 32. In each of the countersunk portions 42, 44 and 46, is received a flat washer 52 and immediately above the flat washer and below the head of the corresponding cap screw, a lock washer 54.

When the collar 18 is positioned on the male launching tube 10 as shown in FIG. 3, the inner ends of the ports 26, 28, 30 and 32 will mate respectively with holes 56, 58, 60 and 62 in the launching tube 10 itself. The holes 56, 58 and 60 through the male launching tube 10 are preferably unthreaded; however, the hole 62 is preferably threaded so as to receive the upper threaded end 50 of the cap screw 48 so as to lock the collar 18 in position on the male launching tube 10. In this regard, the threaded shank of the cap screw 48 is somewhat longer than the threaded shanks on the cap screws 34 and 36.

Figure 4:
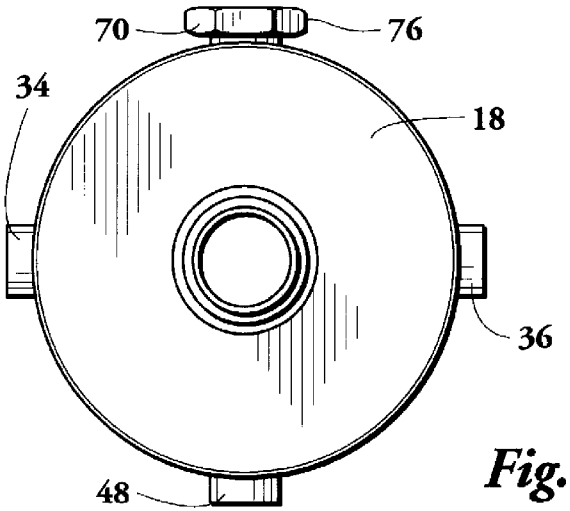
FIG. 4 is a side or end elevation view of the collar shown in FIG. 3 looking along viewing line 4—4 of FIG. 3.

The upper end of the vertical port 26 is provided with an enlarged portion 64 which meets with the port 26 to form a shoulder 66. The upper end of the enlarged port 64 is threaded as at 68 so as to receive a hollow threaded plug 70 which has an internal bore 72 therethrough. The head of the plug 70 is a hex head 76 as shown in FIG. 4. A rupture disk 74 rests against the shoulder 66 and is positioned below the bottom of the threaded plug 70. Tightening the threaded plug 70 will hold the rupture disk 74 firmly in position against the shoulder 66.

As will appear hereinafter, the collar 18 with its various ports 26, 28, 30 and 32, together with the cap screws and threaded plug received therein, satisfies the stated objects set forth above; that is, if a projectile (later to be described) becomes stuck on the male launching tube, or if there were some type of bore obstruction which would prevent the free discharge of the extreme pressure of the propellent energy charge to escape from the launching tube, such problems could result in a burst barrel or burst discharge end of the firearm, energy device, or powered pressure device, and/or cause extreme bodily injury to the operator. If such extreme pressure should occur and the relief thereof could not be vented in the customary manner; i.e., by propelling the projectile, then the disk 74 would rupture and allow the excess pressure to be vented to the atmosphere through the port 72 in the threaded plug 70. Thus, the threaded plug 70 considered in light of the pressure disk 74, constitutes a safety valve. Obviously, other types of safety devices, instead of the rupture disk 74, could be mounted in the port 26 to provide a safety valve and alternative valves could be a ball and spring or other recognized safety valve to prevent excess pressure within the system.

Figure 5:
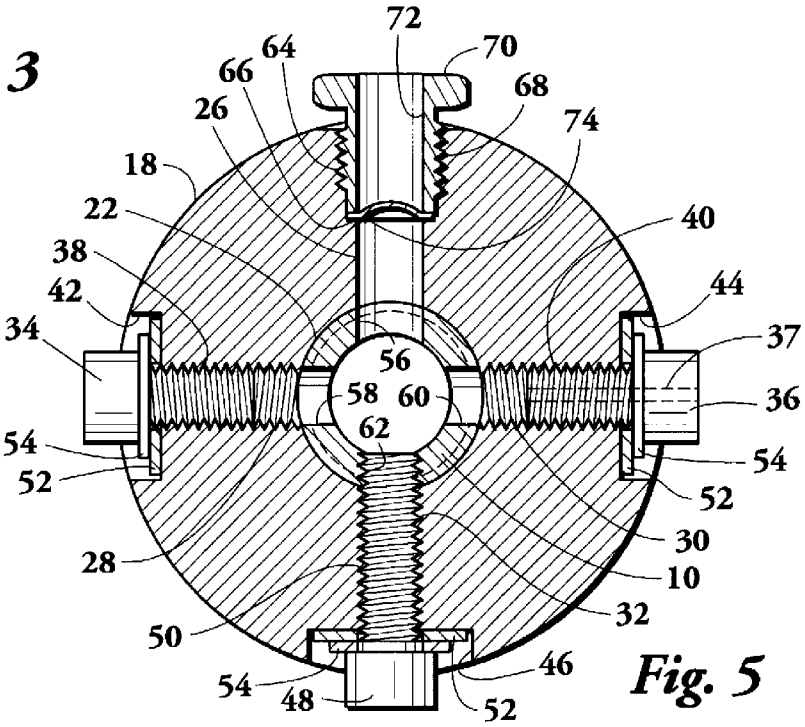
FIG. 5 is an axial sectional view of the collar shown in FIG. 3 and taken along section line 5—5 of FIG. 3.

The collar 18 and the associated ports, cap screws and plug, as described above, also serve to satisfy the needs of another object stated above; that is, it is desired to widely adjust the distance of travel of the projectile while using a specific amount of propellent energy charge or energy pressure charge by incorporating the use of pressure exhaust ports. The ports 28 and 30 are such pressure exhaust ports. In this regard, the diameters or sizes of the ports 28 and 30, as shown in FIG. 5, need not necessarily be as shown, and the sizes of the ports 28 and 30 need not be the same as each other. The plug 34, if removed, would permit a reduction in the pressure of the gas coming out of the end of the male launching tube 10. Obviously the pressure could still be further reduced by removing the other cap screw 36. Either or both of the cap screws 34 and 36 could have a longitudinal bore 37 extending through the cap screw from the atmosphere to the inside of the associated passage 28 or 30. Such bores (such as 37) could vary in size so as to provide a very wide area of adjustability with respect to pressure of the gas discharging from the end of the male launching tube 10.

Figure 2:
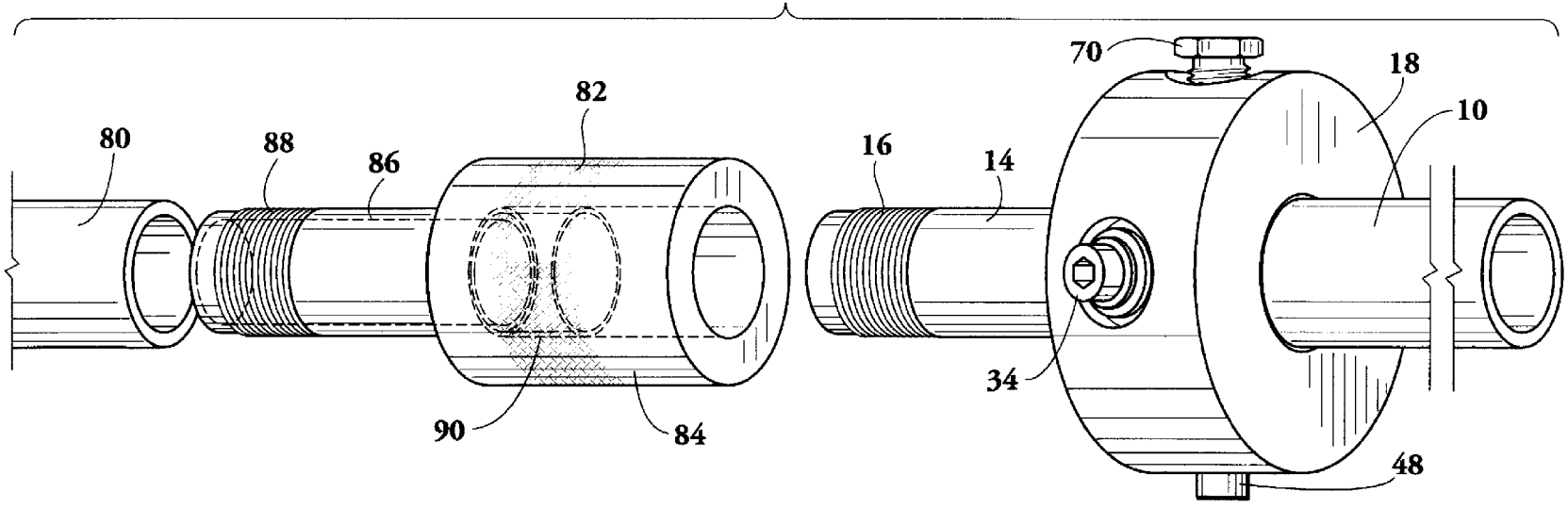
FIG. 2 is an exploded view of another embodiment of my invention.

In the event that the shotgun (not shown) or other firearm or energy device was not provided with threads which would cooperate with the threads 16 shown on the left-hand end of the adaptor portion 14 of the male launching tube 10, FIG. 2 shows a structure which could be used in conjunction with an energy device 80 such as a shotgun, pistol, small cannon, or other energy device. In the case of the energy device 80 shown in FIG. 2, it will be assumed that it has internal threads (not shown) other than those compatible with the threads 16 referred to above. For the purposes of FIG. 2, an adaptor 82 is provided, having a female portion 84 and a cylindrical male adaptor portion 86 extending to the left thereof. The male adaptor portion 86 would have threads 88 thereon which would mate with the internal threads (not shown) of the energy device 80. The inside of the female portion 84 would be provided with threads 90 which would then mate with the threads 16 on the adaptor portion 14 of the male launching tube 10.

Figure 7:
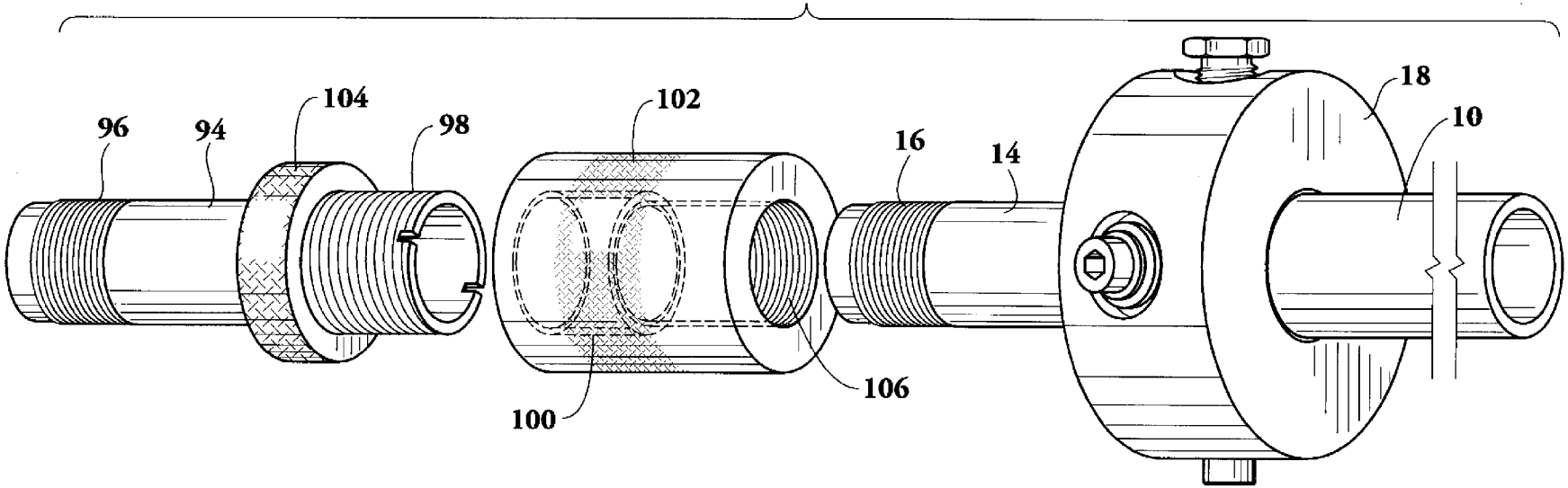
FIG. 7 is an exploded view of another embodiment of the invention.

FIG. 7 represents a modification of FIG. 2 wherein the central element 82 comprised of the male adaptor portion 84 and the female adaptor portion 86 is split into two separate elements. Thus, with respect to FIG. 7, it will be assumed that an energy device (not shown) similar to the energy device 80 shown in FIG. 2, would have an internal threaded portion which would not be directly compatible with the threads 16 on the male adaptor portion 14 of the male launching tube 10. Thus, a male adaptor 94 is provided having threads 96 on the left-hand end thereof adapted to mate with the internal threads (not shown) of the energy device (not shown) with which the assembly of FIG. 7 is intended to cooperate. The male adaptor would have threads 98 at the right-hand end thereof adapted to cooperate with the internal threads 100 on a female adaptor 102. For the purpose of facilitating the introduction of the threaded end 98 into the threads 100 of the female adaptor 102, a knurled bushing 104 is provided on the male adaptor 94 intermediate the ends. The right-hand internal end of the female adaptor 102 is provided with a threaded portion 106 which will mate with the threads 16 on the male adaptor portion 14 of the male launching tube 10.

Figure 6:
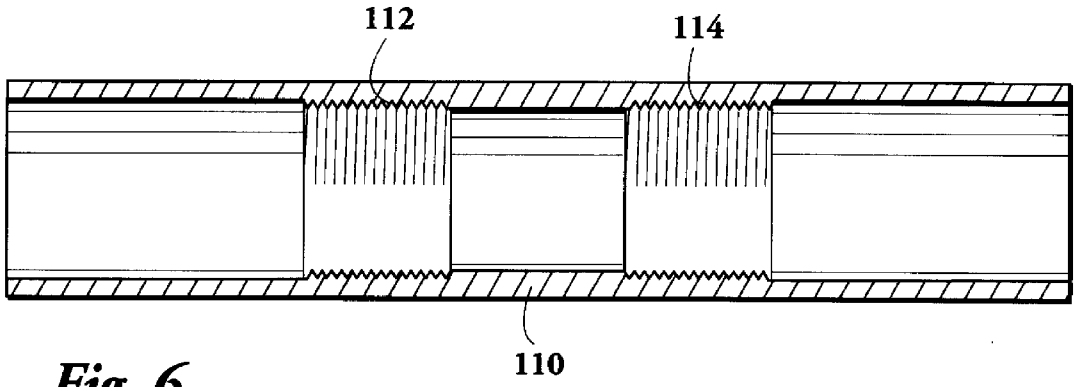
FIG. 6 is a longitudinal sectional view through one embodiment of an adaptor used in the present invention.

FIG. 6 shows a female adaptor 110 which can be used in lieu of the female adaptor 102 shown in FIG. 7. The female adaptor 110 is shown as being longer and not quite as thick walled as the adaptor 102 in FIG. 7. However, the female adaptor 110 would be provided with internal threads 112 located to the left of the center of this member for the purpose of cooperating with threads, such as threads 98 on the male adaptor 94; obviously, the threaded portion 98 on the male adaptor 94 would have to be extended somewhat in order to mate with the threads 112, but this would be within the capability of the man skilled in the art to do this. To the right of the center portion of the female adaptor 110 is a threaded portion 114 which would be adapted to mate with the threads 16 on the male adaptor portion 14 of the launching tube 10. The threads 112 can also mate with threads (not shown) on the end of a barrel of a rifle, shotgun, or other energy device.

Figure 8:
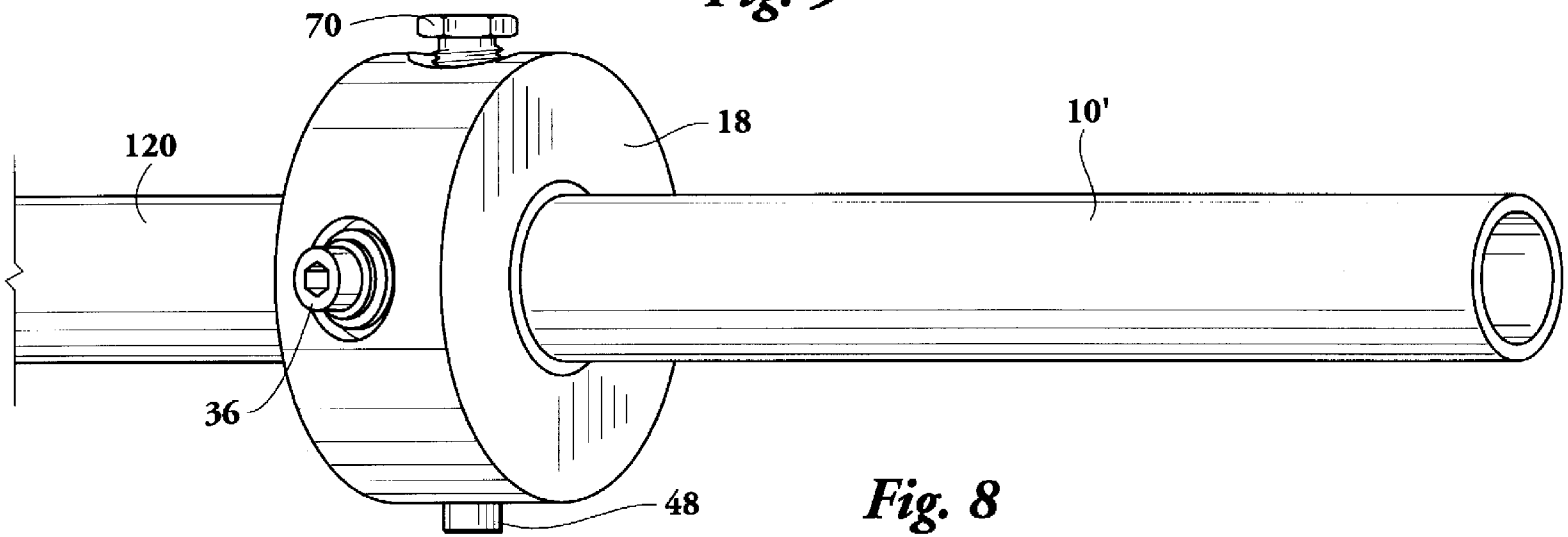
FIG. 8 is a perspective view of another embodiment of the invention showing a male cylindrical launching tube and collar associated with the end of a rifle or other energy device.

FIG. 8 shows another modification of the present invention wherein a launching tube 10' is adapted to connect to the outer end of an energy device 120 which could be a shotgun, pistol, small cannon or other energy device. The collar 18 would be mounted, as shown, on the portion of the male launching tube 10' which abuts the energy device 120. In this regard, the left-hand end of the male launching tube 10' is preferably provided with a boss 122 which can be integrated with or secured to the end of the energy device 120 by means of intermating threads, by welding, or any other suitable means whereby the launching tube 10 will be caused to adhere to or be attached to the energy device 120. Preferably the left-hand end of the boss 122 is provided with a threaded portion 124 which is adapted to mate with the internal threads 124 on the collar 18 as previously described. The only distinction between the collar shown in FIG. 9 and that shown in FIG. 3 is that the collar has been turned 180°.

Figure 9:
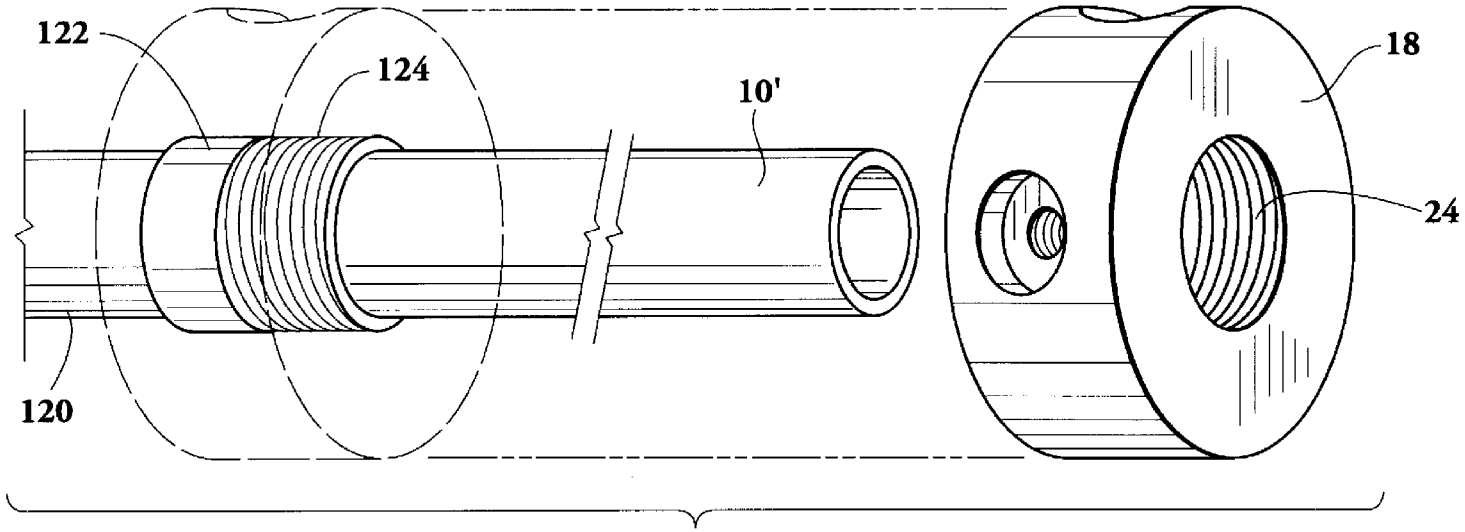
FIG. 9 is an exploded view of the elements shown in FIG. 8.

It should be understood, with respect to the modification shown in FIGS. 8 and 9, that openings would be drilled through the boss 122 so as to provide internal ports or openings that communicate with the interior of the left-hand end of the male launching tube 10' in exactly the same way that the openings 56, 58, 60 and 62 in the member 10 are aligned with and cooperate with the ports 26, 28, 30 and 32 shown in FIG. 5 and described in relation thereto.

FIGS. 8 and 9 represent an embodiment of the present invention where it is unnecessary to "tie in" with a choke portion of a shotgun or other energy device. In fact, the launching tube 10' could be the barrel of the shotgun or other energy device itself. That is, the launching tube 10' could be attached to the energy device as the barrel thereof, in which case the collar 18 could be mounted thereon in several ways. First of all, the collar 18 could be mounted on the barrel 10' of an energy device by using the boss 122 having the threads 124 thereon. In such case, holes would be drilled through the boss and through the barrel 10' of the energy device. In such an instance, the female launching tube 132 would be mounted on the barrel 10' after the collar 18 was put into position as shown in FIG. 8.

In fact, if the member 10' is actually the barrel of an energy device, it is not absolutely essential that a boss 122 be employed. If it was desired to shortcut the features of the boss 122 and the threads 124 thereon, the collar 18 could be placed directly on the barrel of the energy device provided that adequate length was allowed to the right of the collar 18 for the purposes of the female launching tube 132. In such an instance, i.e., where the boss 122 and threads 124 are not employed, the collar 18 could be secured in any way, such as by a snug fit or by welding or brazing after the holes in the collar were properly aligned with the holes in the barrel of the energy device, the round vertical surface of the collar 18 which abuts the end of the female launching tube 132 serves essentially the same purpose as the shield plate 6 disclosed in my prior pending application. That is, when the propellant cartridges discharge in a conventional manner for the firing of a shotgun of standard construction or the firing of a similar cartridge in an equivalent energy device, the propellant gas charge of the cartridge or shotgun shell expands forward through the tube or barrel 10', although the pressure thereof might be modified by the various ports in the collar 18, then the propellant charge expands into the interior of the female cylindrical launching tube 132 and back against the exposed portion of the right-hand surface of the collar 18. Such expansion of the propellant charge sends a projectile in to ballistic flight.

Figure 10:
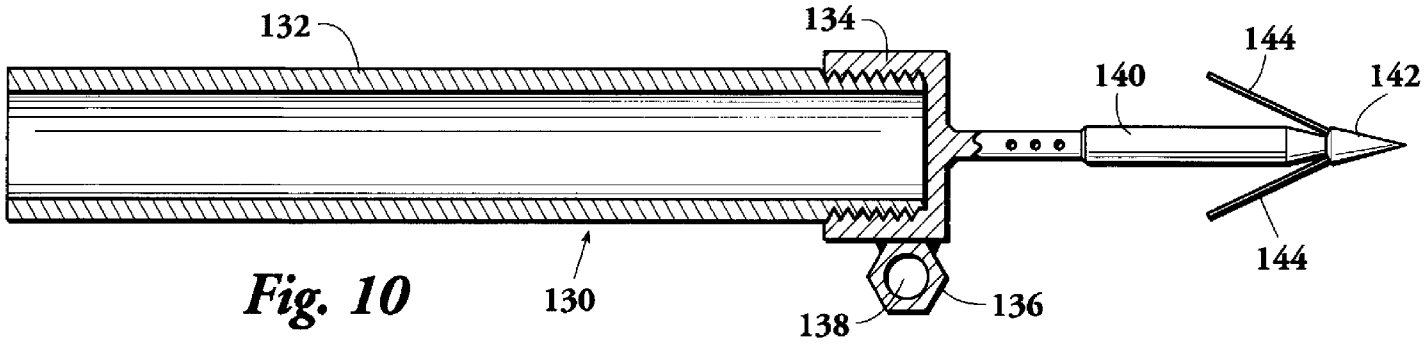
FIG. 10 is a cross-sectional view of one type of projectile which can be used in the present invention. More particularly, this is a harpoon-type projectile.

Referring now to FIG. 10, this shows a harpoon projectile generally designated by the reference character 130. This projectile consists essentially of a cylindrical tube 132 which will be hereinafter referred to as a "female launching tube," and it includes an end cap 134 which is mounted on the right-hand end of the tube 132 by means of interfitting threads on the outer end of the member 132 and female threads on the inner side of the cap 134. The cap 134 has welded thereto a nut 136 which is provided with an opening 138. The female launching tube 132 is adapted to be received over the end of the male launching tube 10 so that the outer end of the male launching tube 10 abuts against the inside of the cap 134. For the purpose of making the device 130 into a harpoon-type projectile, a horizontal rod 140 is connected to the center portion of the cap 134 so as to project horizontally to the right. At the extreme right-hand end of the rod 140 is mounted a pointed member 142 to which legs 144 are attached at a reverse angle. Thus, the pointed member 142 and the legs 144 constitute a barb which can be used to penetrate the wall of a building, a tree, or some other suitable object when the member 130 is fired from the end of the male launching tube. In this regard, when the explosive charge from the energy device passes through the male launching tube 10 into the interior of the female launching tube 132, the pressure, however modified by the collar 18, will cause the barbed projectile 130 to go to whatever distance the device has been adjusted for.

Figure 12:
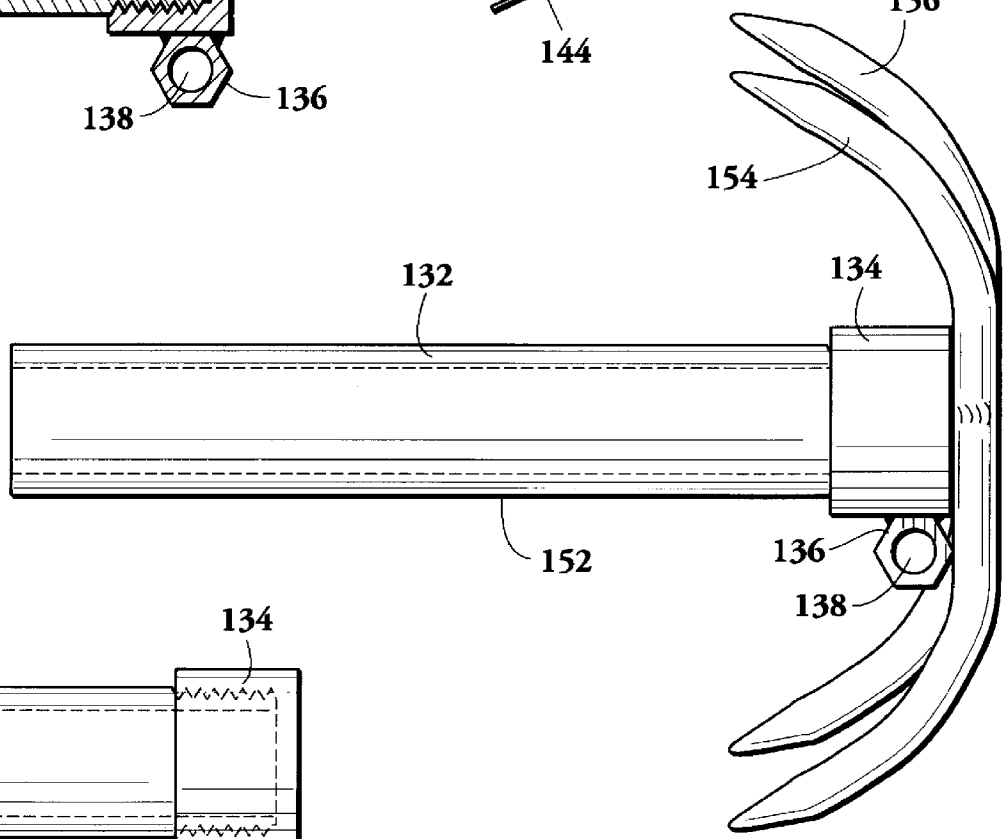
FIG. 12 is a longitudinal elevational view of a grappling hook-type projectile.
Figure 11:
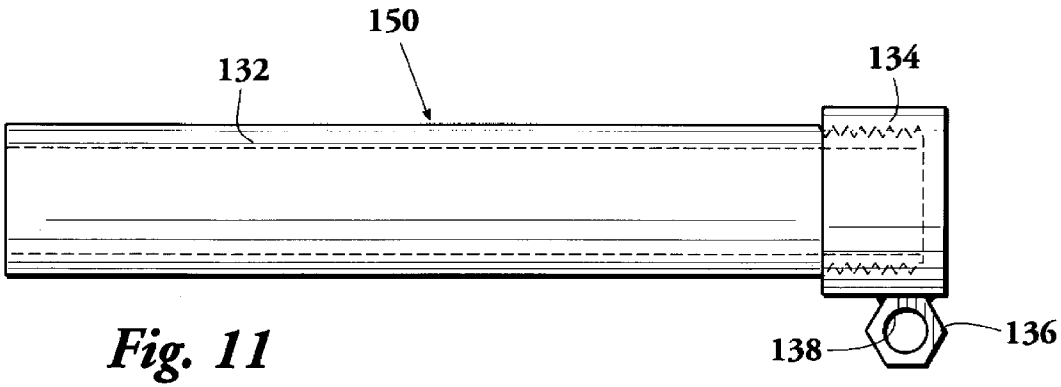
FIG. 11 is a longitudinal elevational view of a payload-type projectile.

FIG. 11 is similar to that shown in FIG. 10 except that the harpoon attachment has been omitted. The projectile of FIG. 11, generally designated by the reference character 150, consists of the same female launching tube 132 and the cap 134 as well as the nut 136. The projectile 150 of FIG. 11 can be, for the sake of convenience, referred to as a "payload device" whereby a rope or cable can be threaded through the opening 138 of the nut 136 so as to carry this rope or cable to whatever location is the final destination of the projectile 150. FIG. 12 shows a launching device generally designated by the reference character 152 which consists also of the same female launching tube 132 and cap 134 together with the nut 136 having its hole 138. In order to make the device 152 of FIG. 12 into a grappling hook, a pair of hook members 154 and 156 are attached to the outer right-hand end of the cap 134 by welding or any suitable means. The grappling hook 12 could be used by firemen, for example, to get to the top of a building for the purpose of securing a line thereto.

Figure 13:
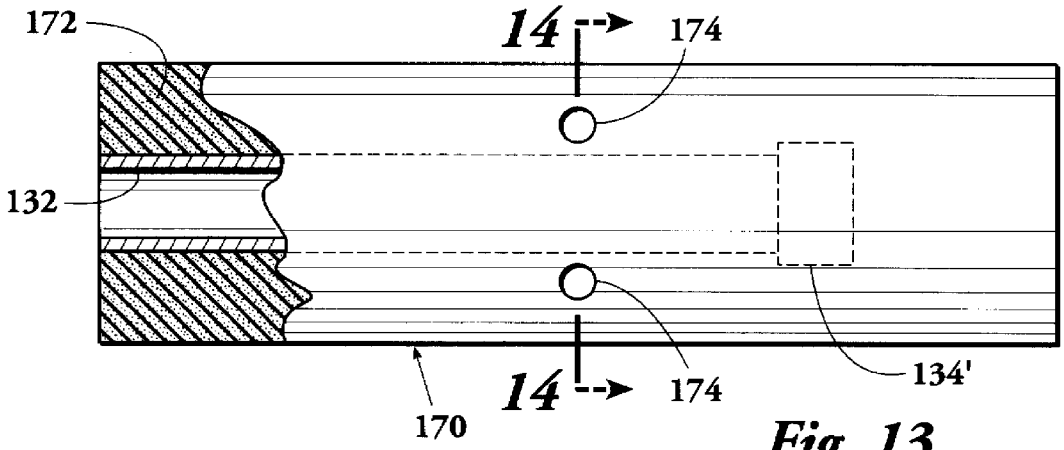
FIG. 13 is a longitudinal elevational view, with one end portion broken away to show internal details, of another type of projectile which can be used with the present invention. More particularly, a rescue buoy or stun member.
Figure 14:
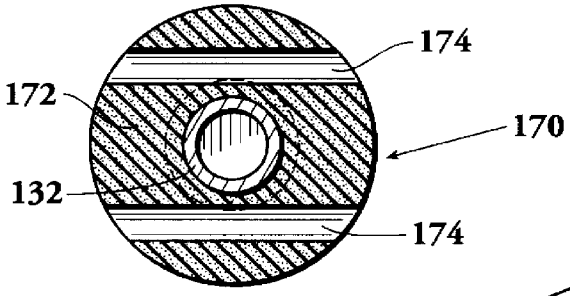
FIG. 14 is an axial cross-sectional view taken along section line 14—14 of FIG. 13.
Figure 15:
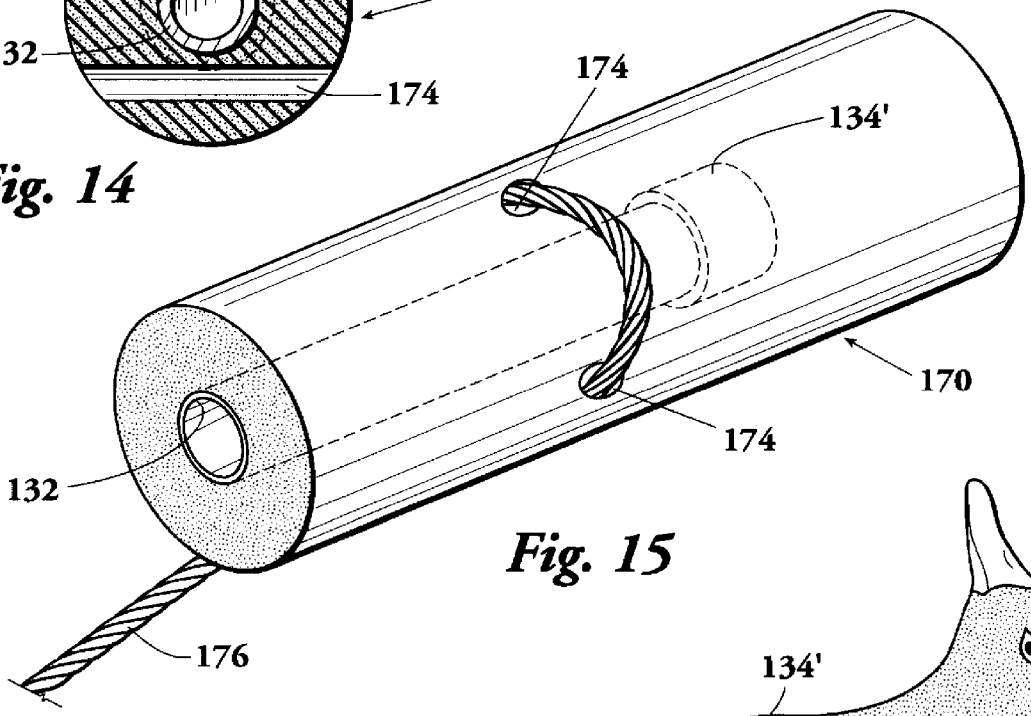
FIG. 15 is a perspective view of the projectile shown in FIG. 13 with a rope or line attached.

FIG. 13 shows a rescue buoy generally designated by the reference numeral 170. This projectile 170 includes, internally, the same female launching tube 132 with a modified cap 134' and a cylindrical coating 172 made of foamed urethane or other substance which would make the projectile 130 floatable on a body of water, for example. The projectile 170 is also provided with a pair of transverse bores or openings 174 which would permit the insertion of and tying of a rope or cable 176 to the projectile 170 as best shown in FIG. 15.

Figure 16:
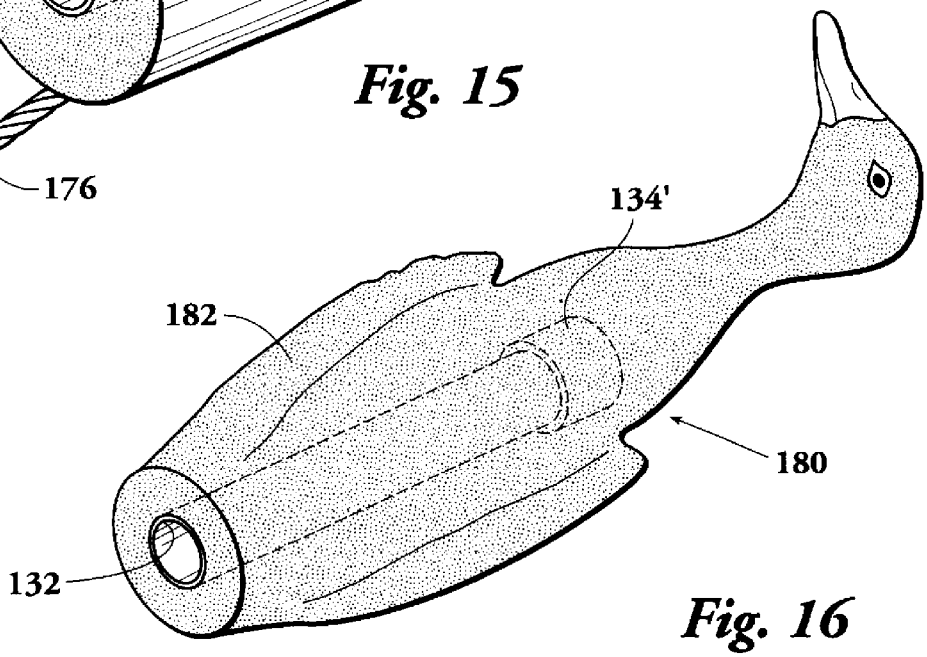
FIG. 16 is a perspective view of a projectile representing a dead bird or, more particularly, a dead duck.

FIG. 16 shows a projectile generally designated by the reference numeral 180 which can also be referred to as a "dead bird" or "dead duck." The interior of the projectile 180 includes the same female launching tube 132 and the modified cap 134'. Instead of having the floatable foamed polystyrene 172, a body 182 (floatable or otherwise) is formed around the female launching tube 132 so as to resemble a duck's head and portion of the duck's body as shown in FIG. 16.

Figure 18:
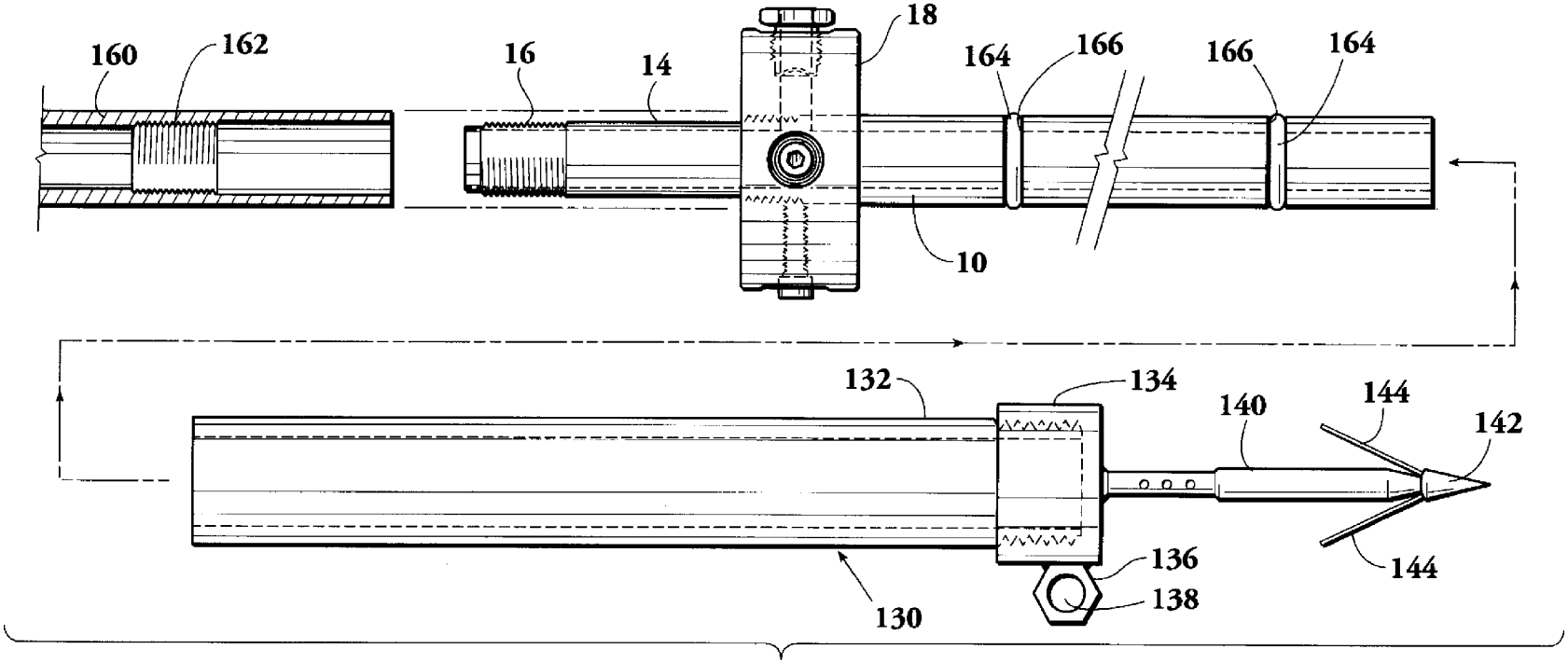

FIGS. 17 and 18 show the mounting of the harpoon device 130 of FIG. 10 on the end of a male launching tube 10 and associated collar as shown in FIG. 3 further in association with a shotgun 160 or other energy device such as a pistol, a small cannon, or other energy device, having an internal threaded portion 162 adapted for receiving a replaceable choke therein but, in any event, having a threaded portion which is compatible with the threaded end 16 on the male adaptor portion 14 of the male launching tube 10. FIG. 18 also shows O-rings 164 mounted in grooves 166 on the external surface of the male launching tube 10. The use of O-rings is considered optional, but one or more of such rings might improve the "fit" between the male launching tube 10 and the female launching tube 132.

Whereas, the present invention has been described in particular relation to the drawings attached hereto, other and further modifications, apart from those shown or suggested herein, may be made within the spirit and scope of this invention.

What is claimed is:

1. Apparatus for launching a projectile comprising a male launching tube having an attachment end and a discharge end opposite from said attachment end, an energy device having a discharge end and having the capability of producing an instantaneous discharge of gas under high pressure from its discharge end, the attachment end of the male launching tube being connected to the discharge end of said energy device whereby the high pressure gases discharging from the discharge end of said energy device are passed through said male launching tube and out the discharge end thereof, a collar mounted on said male launching tube between the discharge end and the attachment end, and a projectile adapted to be mounted on the male launching tube between the discharge end thereof and the collar whereby, when the energy device discharges gas therefrom under high pressure such that the gas expands into the interior of the projectile and back against the collar, said projectile will be launched into ballistic flight, said collar having a port extending radially therethrough to the male launching tube, wherein said male launching tube is provided with a first radial hole extending through the male launching tube communicating with the radial port in the collar and with the interior of the male launching tube.

2. Apparatus for launching a projectile as set forth in claim 1 wherein said radial port is a pressure port so as to modify the pressure at the discharge end of said male launching tube.

3. Apparatus for launching a projectile as set forth in claim 2 wherein a removable plug is received in said pressure port.

4. Apparatus for launching a projectile as set forth in claim 1 wherein said radial port is a safety port and wherein a pressure safety device is mounted in said pressure port to prevent the pressure within said male launching tube from exceeding a predetermined value.

5. Apparatus for launching a projectile as set forth in claim 1 wherein said radial port is a locking port and wherein a pin is received in said locking port and extending all the way into said radial hole in said male launching tube to secure said collar on said male launching tube, thereby preventing relative rotation of said collar with respect to said male launching tube.

6. Apparatus for launching a projectile as set forth in claim 1 wherein said projectile includes a female launching tube adapted to surround the discharge end of said male launching tube.

7. Apparatus for launching a projectile as set forth in claim 6 wherein said female launching tube is provided with a discharge end and an end opposite from said discharge end, the opposite end being received over the male launching tube and the discharge end being provided with a cap which will abut against discharge end of said male launching tube.

8. Apparatus for launching a projectile as set forth in claim 7 wherein the cap is provided with a projecting portion having a hole therein for receiving a line to deliver to a remote location when said projectile is launched by said energy device.

9. Apparatus for launching a projectile as set forth in claim 6 wherein said female launching tube is covered by a floatable casing.

10. Apparatus for launching a projectile as set forth in claim 9 wherein the floatable casing is provided with openings therethrough to permit attachment of a cable or line thereto.

11. Apparatus for launching a projectile as set forth in claim 7 wherein the female launching tube is provided with a harpoon-type device projecting forwardly from said cap.

12. Apparatus for launching a projectile as set forth in claim 7 wherein said female launching tube is provided with grappling hooks attached to said cap.

13. Apparatus for launching a projectile as set forth in claim 7 wherein said female launching tube is covered by a body shaped in the form of a dead bird.

* * * * *